US005465742A

United States Patent [19]

Dudley

[11] Patent Number: 5,465,742

[45] Date of Patent: Nov. 14, 1995

[54] BRAID AID HAIR CLIP

[76] Inventor: Diane J. Dudley, Rte. 1, Box 35I, Lawrenceville, Va. 23868

[21] Appl. No.: 258,677

[22] Filed: Jun. 13, 1994

[51] Int. Cl.[6] ..... A45D 8/26

[52] U.S. Cl. ..... 132/279; 132/212; 28/42

[58] Field of Search ..... 132/273, 275, 132/277, 278, 279, 270, 212; D28/39, 40, 42, 43; 446/295

[56] References Cited

U.S. PATENT DOCUMENTS

| | | | |
|---|---|---|---|
| D. 309,835 | 8/1990 | Stone, Jr. et al. | D28/42 X |
| 2,142,849 | 1/1939 | Huppert | 132/279 |
| 2,242,674 | 5/1991 | Huppert | 132/279 |
| 2,811,749 | 11/1957 | David | 132/279 X |
| 4,108,184 | 8/1978 | Morganroth | 132/273 |
| 5,109,878 | 5/1992 | Kuo-Hua | 132/279 |

FOREIGN PATENT DOCUMENTS

| | | | |
|---|---|---|---|
| 115867 | 1/1930 | Australia | 132/279 |
| 1222694 | 6/1960 | France | 132/279 |
| 6007215 | 1/1994 | Japan | 132/279 |

*Primary Examiner*—John G. Weiss
*Attorney, Agent, or Firm*—Michael I. Kroll

[57] ABSTRACT

A braid aid hair clip is provided, which consists of an elongated body member and a clasp. A device is on a first end of the elongated body member, for pivoting a first end of the clasp. An apparatus is on a second end of the elongated body member, for holding a second end of the clasp in a closed position. A structure is on the elongated body member for automatically dividing hair from a head of hair between the elongated body member and the clasp into a plurality of equal sections when the clasp is in the closed position, so that a woman can begin braiding the hair.

7 Claims, 2 Drawing Sheets

BRAID AID HAIR CLIP

BACKGROUND OF THE INVENTION

1. Field of the Invention

The instant invention relates generally to barrettes and more specifically it relates to a braid aid hair clip.

2. Description of the Prior Art

Numerous barrettes have been provided in prior art. For example, U.S. Pat. Nos. 3,590,830 to Hannum; 3,645,278 to Abraham; 3,998,233 to Door; 4,299,241 to Pieire F. X.; 5,181,530 to Chou; Des. 280,447 to Verducci; Des. 280,942 to Topalian and Des. 318,540 to Carter all are illustrative of such prior art. While these units may be suitable for the particular purpose to which they address, they would not be as suitable for the purposes of the present invention as heretofore described.

HANNUM, EVELYN J.

BARRETTE

U.S. Pat. No. 3,590,830

A barrette which comprises a pair of hingedly connected outer and inner body members, one of which is provided with means for grippingly, nonslidably engaging the hair of a wearer and the other is provided with lift means. A means is for manually retracting and extending the lift means relatively to the body member to permit unhindered insertion of the body member in the hair of the user and firm clamping of the hair between the body members when the lift means is extended relatively to the body member in which it is mounted.

ABRAHAM, ANTON

HAIR SECURING MEANS, PARTICULARLY A HAIR-CLASP OR BARRETTE, OR A HAIR-COMB WITH SUCH SECURING MEANS

U.S. Pat. No. 3,645,278

A hair securing means, such as a hair-clasp or barrette, or a hair-comb, which comprise a pivotal resilient locking lever and a locking pin provided with a panlike recess having two surfaces which are inclined at an angle to each other. The locking lever cooperates with the locking pin by engaging the panlike recess. The locking pin has a head in the shape of the surface of the circumference of a circular cylinder. The longitudinal axis of the latter is the apex line of the panlike recess. The surface of the latter extends at least to one half of the circular circumference. The locking lever is provided with a rectangular opening. The length of the opening corresponds to the width of the head. The width of the opening corresponds to the thickness of the head plus an amount less that the depth of the recess.

DORR, IRENE M.

BARRETTE WITH SWIVELED HINGE

U.S. Pat. No. 3,998,233

The invention relates to a novel barrette structure useable in the manner of similar prior art structures and is alternately capable of 360 degrees rotation about the closed end thereof to facilitate styling of the hair.

PIERRE F. X., SEILLER

HINGE FOR HAIR CLIP, BARRETTE OR THE LIKE

U.S. Pat. No. 4,299,241

A hinge for a barrette, hairclip or the like has a base of rectangular configuration formed along its short ends with a pair of upstanding lugs forming cheeks between which the legs of a clip arm are retained. The legs have inwardly bent feet which are engaged between a pair of cleats extending along the long sides of the base and bent over these feet to swingably mount the arm.

CHOU, KUO-HUA

HAIR CLIP

U.S. Pat. No. 5,181,530

A barrette comprises an elongate, arched holder made from a plastic strip and an elongate, arched metal clip member. The holder has embossed end portions which are folded against the concave side of the holder and held in place by clamping tabs extending from the longitudinal edges thereon. Each folded end portion has a raised embossment defining a receiving cavity with an L-shaped entrance slit around a periphery thereon. Opposing end portions of the clip member are inserted laterally into corresponding cavities on the holder and retained therein by cooperating snap appendages and engagement surfaces. A protruding catch on each end portion of the clip member engages a rectangular aperture on a corresponding raised embossment. Further securement is provided by an inclined catch on the inner terminal edge of each folded end portion which snap engages a corresponding aperture on the clip member.

VERDUCCI, HENRY A.

BARRETTE

U.S. Pat. No. Des. 280,447

The ornamental design for a barrette, substantially as shown and described.

The broken line disclosure is illustrative of environment only.

Topalian, Joan A.

HAIR BARRETTE

U.S. Pat. No. Des. 280,942

The ornamental design for a hair barrette, as shown and described.

Figure 1:
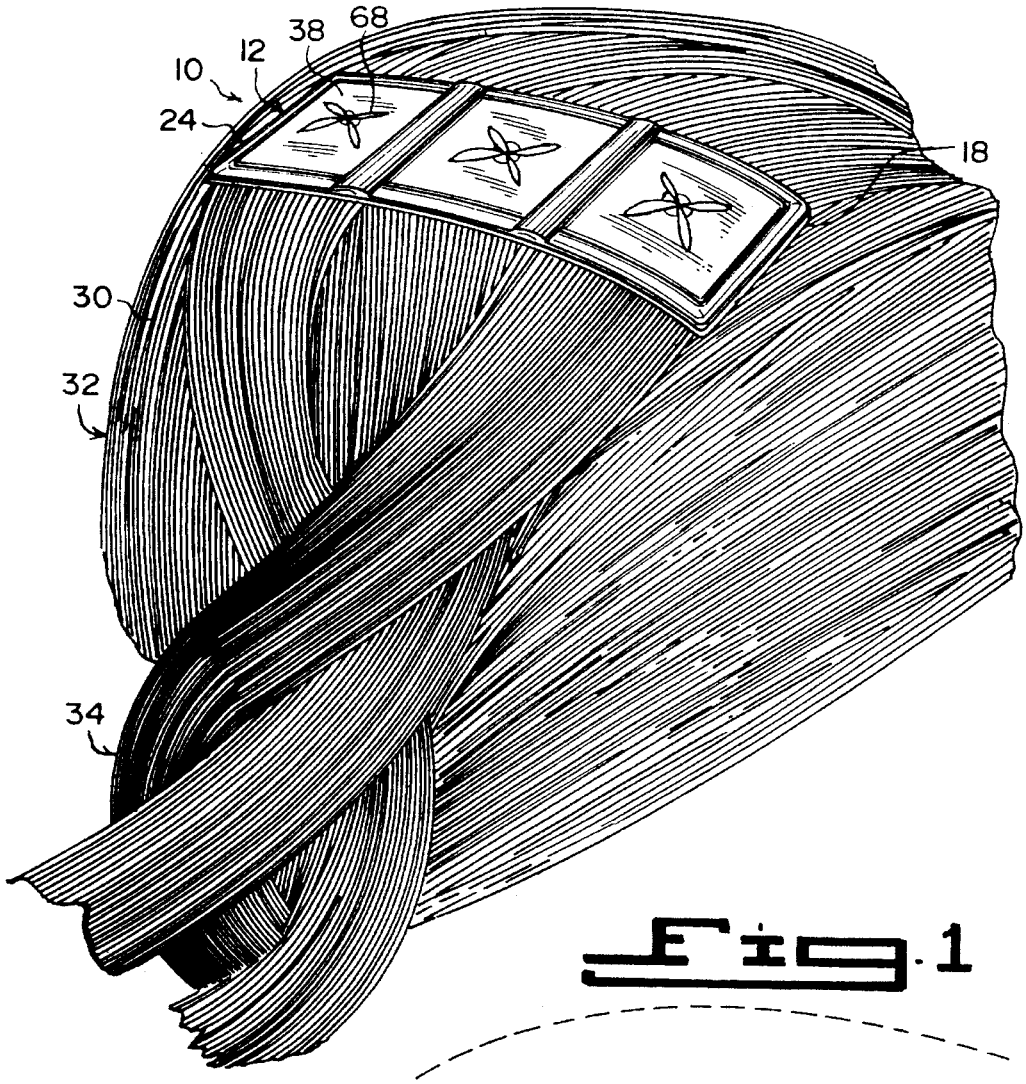
FIG. 1 is a top plan view of a barrette showing a new design.

FIG. 1 is a left edge elevational view of a hair barrette showing a new design.

Figure 2:
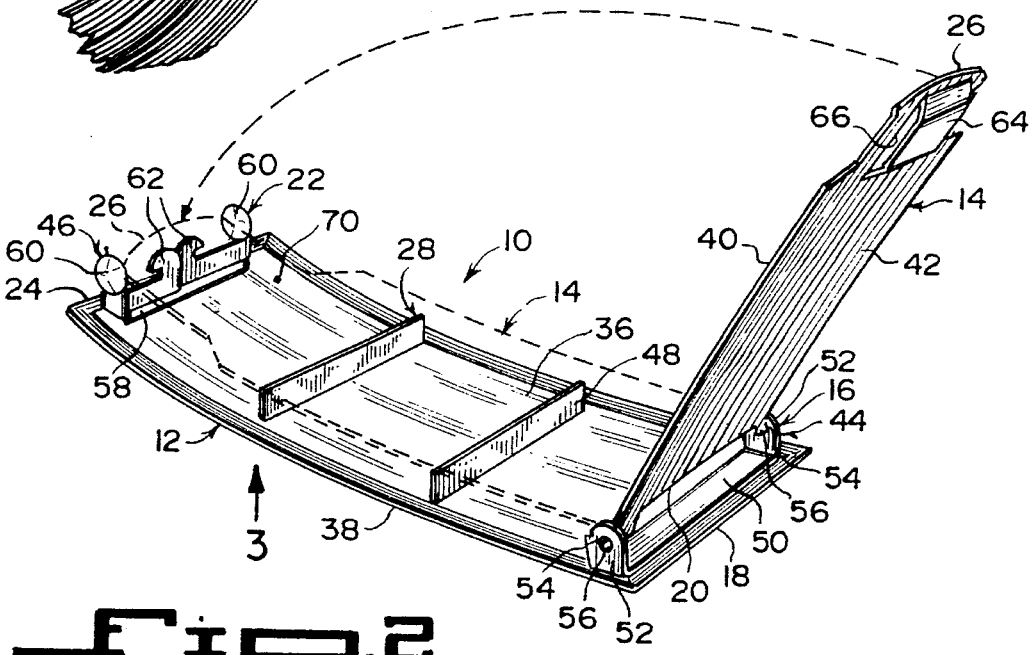
FIG. 2 is a bottom plan view thereof.

FIG. 2 is a front elevational view thereof.

Figure 3:
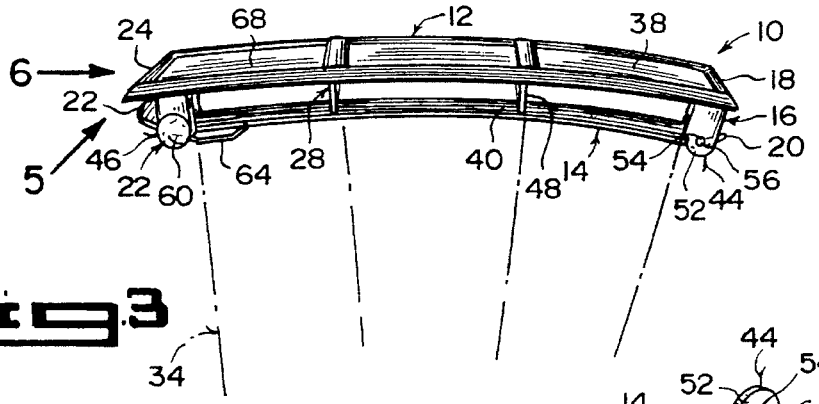
FIG. 3 is an enlarged right end view thereof.

FIG. 3 is a right edge elevational view thereof.

Figure 4:
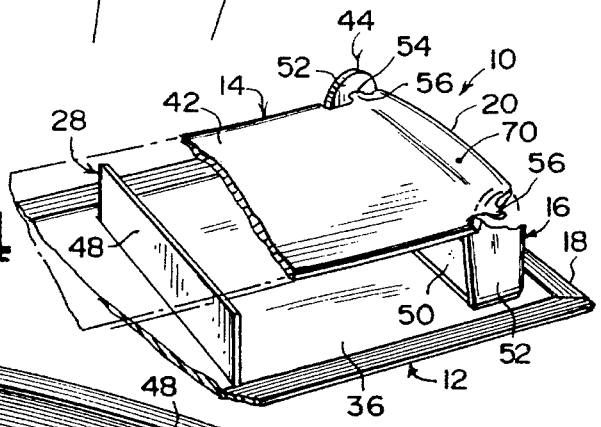
FIG. 4 is an enlarged left end view thereof.

FIG. 4 is a rear elevational view thereof.

Figure 5:
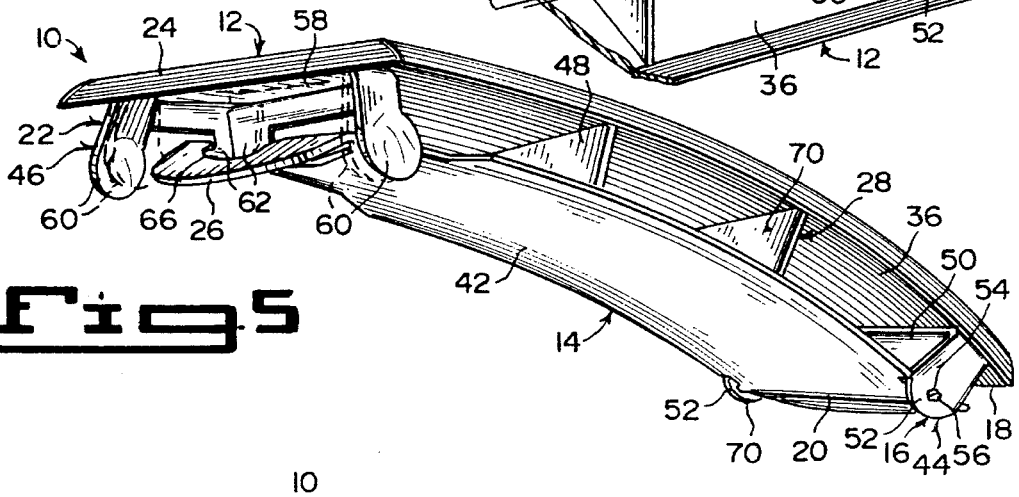
FIG. 5 is a side elevational view thereof.

FIG. 5 is a bottom plan view thereof.

Figure 6:
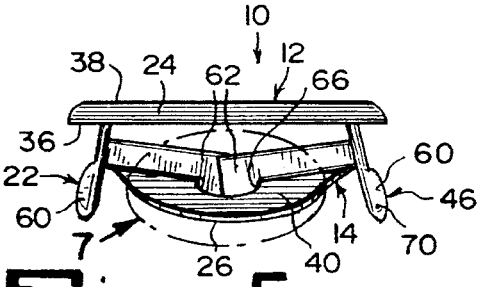

FIG. 6 is an edge view of the barrette in a closed position.

Figure 7:
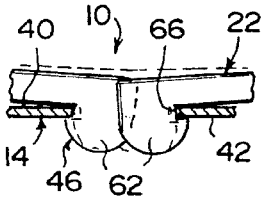

FIG. 7 is a front elevational view of the barrette in a closed position.

CARTER, ALAN C.

HAIR BARRETTE

U.S. Pat. No. Des. 318,540

The ornamental design for a hair barrette, as shown and described.

FIG. 1 is a perspective view of a hair barrette showing a new design.

FIG. 2 is a top plan view thereof.

FIG. 3 is a front elevational view thereof.

FIG. 4 is a bottom plan view thereof.

FIG. 5 is a side elevational view thereof, with the barrette in a reversed position in relation to the clasp.

The broken line showing of the woman is for illustrative purposes only and forms no part of the claimed design.

SUMMARY OF THE INVENTION

A primary object of the present invention is to provide a braid aid hair clip that will overcome the shortcomings of the prior art devices.

Another object is to provide a braid aid hair clip that will automatically divide the hair into a plurality of sections when clamped into the hair, so that a woman can begin braiding the hair.

An additional object is to provide a braid aid hair clip in which the elongated body member contains a plurality of equally spaced apart transverse dividers to separate the hair into the plurality of sections when a hinged clasp is retained to the elongated body member.

A further object is to provide a braid aid hair clip that is simple and easy to use.

A still further object is to provide a braid aid hair clip that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top perspective view of the instant invention being worn on a head of hair, so that the hair can be braided.

FIG. 2 is a bottom perspective view of the instant invention per se with the clasp opened.

FIG. 3 is a top perspective view taken in the direction of arrow 3 in FIG. 2, with the clasp closed.

FIG. 4 is an enlarged bottom perspective view of a portion thereof with parts broken away showing the hinge fitting in grater detail and the clasp closed.

FIG. 5 is a bottom perspective view taken in the direction of arrow 5 in FIG. 3.

FIG. 6 is an end view taken in the direction of arrow 6 in FIG. 3.

FIG. 7 is a cross sectional view of the area as indicated by arrow 7 in FIG. 6.

DETAILED DESCRIPTION OF THE PREFERRED EMBODIMENTS

Turning now descriptively to the drawings, in which similar reference characters denote similar elements throughout the several views, FIGS. 1 through 7 illustrate a braid aid hair clip 10, which consists of an elongated body member 12 and a clasp 14. A device 16 is on a first end 18 of the elongated body member 12, for pivoting a first end 20 of the clasp 14. An apparatus 22 is on a second end 24 of the elongated body member 12, for holding a second end 26 of the clasp 14 in a closed position. A structure 28 is on the elongated body member 12, for automatically dividing hair 30 from a head of hair 32 between the elongated body member 12 and the clasp 14 into a plurality of equal sections 34, when the clasp 14 is in the closed position, so that a woman can begin braiding the hair 30.

The elongated body member 12 is rectangular shaped, having a concave reverse side 36 and a convex obverse side 38. The clasp 14 is flexible and generally rectangular shaped, having a concave reverse side 40 and a convex obverse side 42, so that when held in the closed position the clasp 14 will be generally parallel with the elongated body member 12.

The pivoting device 16 is a hinge assembly 44 extending transversely across and between the first end 18 of the elongated body member 12 and the first end 20 of the clasp 14. The holding apparatus 22 is a retainer assembly 46, extending transversely across and between the second end 24 of the elongated body member 12 and the second end 26 of the clasp 14. The hair dividing structure 28 is a plurality of partitions 48, equally spaced apart and transversely affixed to the concave reverse side of the elongated body member 12, so as to be parallel with the first end and the second end 24 thereof, forming equal sized passageways therethrough for the hair 30, when the clasp 14 is held in the closed position.

The hinge assembly 44 includes a rectangular base plate 50 affixed to the concave reverse side 36 adjacent the first end 18 of the elongated body member 12. A pair of lugs 52 are provided, with each having a hole 54 therethrough and integral at a right angle with one short end of the rectangular base plate 50. A pair of pins 56 are also provided, with each integral with an extending outwardly at a right angle from one long side adjacent the first end 20 of the clasp 14. The pins 56 can enter the holes 54 in the lugs 52 to pivot thereabout.

The retainer assembly 46 consists of a rectangular base plate 58 affixed to the concave reverse side 36 adjacent the second end 24 of the elongated body member 12. A pair of finger squeeze portions 60 are provided, with each integral with an extending at a right angle from one short end of the rectangular base plate 58. A pair of hook portions 62 are also provided, with each integral with one finger squeeze portion 60 and extends inwardly to overlap each other. The clasp 14 has a push out area 64 to form an aperture 66 adjacent the second end 26 thereof. When the clasp 14 is in the closed position, the hook portions 62 will engage with the aperture 66 in the clasp 14. When the finger squeeze portions 60 are pressed towards each other, they will release the hook portions 62 from the aperture 66 in the clasp 14, to allow the clasp 14 to go into the opened position.

The elongated body member 12 can contain a decorative pattern 68 on the convex obverse side 38, so as to enhance the appearance of the elongated body member 12, when worn in the hair 30 on the head of hair 32.

The elongated body member 12, the clasp 14, the hinge assembly 44, the retainer assembly 46 and the partitions 48 are all fabricated out of a durable strong material 70, such as a non-corrosive metal or plastic.

OPERATION OF THE INVENTION

To use the braid aid hair clip 10, the following steps should be taken:

1. Press the finger squeeze ports 60 towards each other, to release the hook portions 62 from the aperture 66 in the clasp 14.

2. Lift the second end 26 of the clasp 14, so that the first end 20 will rotate in the hinge assembly 44.

3. Insert the elongated body member 12 into the hair 30, so that each section 34 of the hair 30 will pass between the partitions 48.

4. Return the second end 26 of the clasp 14 back to the retainer assembly 46.

5. Press down on the second end 26, so that the hook portions 62 will engage with the aperture 66 again in the closed position.

6. Start braiding the sections 34 of the hair 30 together to form the braid.

LIST OF REFERENCE NUMBERS

| | |
|---|---|
| 10 | braid aid hair clip |
| 12 | elongated body member |
| 14 | clasp |
| 16 | pivoting device |
| 18 | first end of 12 |
| 20 | first end of 14 |
| 22 | holding apparatus |
| 24 | second end of 12 |
| 26 | second end of 14 |
| 28 | hair dividing structure on 12 |
| 30 | hair |
| 32 | head of hair |
| 34 | section of 30 |
| 36 | concave reverse side of 12 |
| 38 | convex obverse side of 12 |
| 40 | concave reverse side of 14 |
| 42 | convex obverse side of 14 |
| 44 | hinge assembly for 16 |
| 46 | retainer assembly for 22 |
| 48 | partition of 28 |
| 50 | rectangular base plate of 44 |
| 52 | lug of 44 |
| 54 | hole in 52 |
| 56 | pin on 14 |
| 58 | rectangular base plate of 46 |
| 60 | finger squeeze portion of 46 |
| 62 | hook portion of 46 |
| 64 | push out area in 14 |
| 66 | aperture in 14 |
| 68 | decorative pattern on 38 |
| 70 | durable strong material |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A braid aid hair clip which comprises:

a) an elongated body member of rectangular configuration having a pair of short ends;

b) a clasp;

c) means on a first short end of said elongated body member for pivoting a first end of said clasp;

d) means on the opposite second short end of said elongated body member for holding a second end of said clasp in a closed position; and e) means on said elongated body member for preparing a head of hair for braiding by automatically dividing said hair placed between said elongated body member and said clasp into three equal sections when said clasp is in the closed position comprising a pair of elongated partitions extending substantially the full width of said body member, parallel to and equally spaced between the short ends of said elongated body member to establish three identically sized, parallel sections of hair for braiding.

2. A braid aid hair clip as recited in claim 1, wherein said elongated body member has a concave reverse side and a convex obverse side.

3. A braid aid hair clip as recited in claim 2, wherein said clasp is flexible and generally rectangular shaped having a concave reverse side and a convex obverse side, so that when held in the closed position, said clasp will be generally parallel with said elongated body member.

4. A braid aid hair clip as recited in claim 3, wherein said pivoting means is a hinge assembly extending transversely across and between the first end of said elongated body member and the first end of said clasp.

5. A braid aid hair clip as recited in claim 4, wherein said holding means is a retainer assembly extending transversely across and between the second end of said elongated body member and the second end of said clasp.

6. A braid aid hair clip as recited in claim 5, wherein said hinge assembly includes:

a) a rectangular base plate affixed to the concave reverse side adjacent the first end of said elongated body member;

b) a pair of lugs, each having a hole therethrough and integral at a right angle with one short end of said rectangular base plate; and c) a pair of pins, each integral with and extending outwardly at a right angle from one long side adjacent the first end of said clasp, so that said pins can enter the holes in said lugs to pivot thereabout.

7. A braid aid hair clip as recited in claim 6, wherein said retainer assembly includes:

a) a rectangular base plate affixed to the concave reverse side adjacent the second end of said elongated body member;

b) a pair of finger squeeze portions, each integral with and extending at a right angle from one short end of said rectangular base plate;

c) a pair of hook portions, each integral with one said finger squeeze portion and extending inwardly to overlap each other; and d) said clasp having a push out area to form an aperture adjacent the second end thereof, so that when said clasp is in the closed position said hook portions will engage with said aperture in said clasp, until said finger squeeze portions are pressed towards each other to release said hook portions from said aperture in said clasp, to allow said clasp to go into the opened position.

* * * * *